US011571603B2

(12) United States Patent
Ho

(10) Patent No.: US 11,571,603 B2
(45) Date of Patent: Feb. 7, 2023

(54) MULTI-FUNCTION FOLDABLE EXERCISE EQUIPMENT

(71) Applicant: Willy Wei Yu Ho, Boyton Beach, FL (US)

(72) Inventor: Willy Wei Yu Ho, Boyton Beach, FL (US)

( * ) Notice: Subject to any disclaimer, the term of this patent is extended or adjusted under 35 U.S.C. 154(b) by 50 days.

(21) Appl. No.: 17/145,540

(22) Filed: Jan. 11, 2021

(65) Prior Publication Data

US 2022/0219039 A1 Jul. 14, 2022

(51) Int. Cl.

| | |
|---|---|
| ***A63B 21/00*** | (2006.01) |
| ***A63B 23/035*** | (2006.01) |
| ***A63B 22/06*** | (2006.01) |

(52) U.S. Cl.

CPC .... *A63B 21/4049* (2015.10); *A63B 21/00069* (2013.01); *A63B 21/4033* (2015.10); *A63B 22/0605* (2013.01); *A63B 23/03525* (2013.01); *A63B 2022/0652* (2013.01); *A63B 2210/50* (2013.01); *A63B 2225/09* (2013.01)

(58) Field of Classification Search

CPC ..... A63B 21/4049; A63B 21/00069; A63B 21/4033; A63B 22/0605; A63B 23/03525; A63B 2022/0652; A63B 2210/50; A63B 2225/09

See application file for complete search history.

(56) References Cited

U.S. PATENT DOCUMENTS

| | | | | | |
|---|---|---|---|---|---|
| 1,386,206 | A * | 8/1921 | Samuelson | A63B 23/0476 | 482/62 |
| 2,416,471 | A * | 2/1947 | De Chappedelaine | A63B 35/04 | 440/27 |
| 3,056,603 | A * | 10/1962 | Levine | A63B 22/0007 | 482/57 |
| 3,058,742 | A * | 10/1962 | Jaffe | A63B 22/0007 | 482/63 |
| 3,227,447 | A * | 1/1966 | Baker | A63B 21/169 | 74/545 |
| 3,259,385 | A * | 7/1966 | Boren | A63B 22/0694 | 248/165 |
| 3,601,395 | A * | 8/1971 | Morgan | A63B 22/0605 | 74/551.8 |

(Continued)

*Primary Examiner* — Andrew S Lo
*Assistant Examiner* — Andrew M Kobylarz
(74) *Attorney, Agent, or Firm* — Womble Bond Dickinson (US) LLP

(57) ABSTRACT

An exercising equipment having base formed of a U-shape pipe; first and second arms, each rotatably connected to the base and having a securing knob engageable to affix the arm at an acute angle to the base; first paddle rotatably connected at a first connecting point to the first arm; second paddle rotatably connected at a second connecting point to the second arm; foldable connecting bar assembly connected at one end to the first paddle and at the second end to the second paddle, to thereby form an S-shape together with the first and second paddles when assuming an extended position and form a W-shape together with the first and second paddles when assuming a folded position; and, at least one variable friction pivot assembly attached at the first or second connecting points thereby applying variable friction to rotation of at least one of the first or second paddles.

20 Claims, 9 Drawing Sheets

(56) References Cited

U.S. PATENT DOCUMENTS 3,751,033 A * 8/1973 Rosenthal ..... A63B 21/1609 482/63
3,848,870 A * 11/1974 Craig ..... A63B 22/0012 482/121
3,968,963 A * 7/1976 Sileo ..... A63B 22/0605 482/137
4,169,591 A * 10/1979 Douglas ..... A63B 22/001 5/651
4,225,130 A * 9/1980 Zimmerman ..... A63B 22/0605 482/60
4,257,588 A * 3/1981 Ketchman ..... A63B 22/0005 74/551.9
4,521,009 A * 6/1985 Pomeroy ..... A63B 22/0694 482/63
5,354,249 A * 10/1994 Raley ..... A63B 22/0007 482/57
5,902,218 A * 5/1999 Froelich, Sr. ..... A63B 21/4035 482/118
6,090,023 A * 7/2000 Liu ..... A63B 21/4047 482/130
6,592,500 B1 * 7/2003 McBride ..... A63B 23/0211 482/907
6,824,503 B2 * 11/2004 Wang ..... A63B 22/0605 482/60
7,618,354 B2 * 11/2009 Wu ..... A63B 21/015 482/52
7,901,331 B1 * 3/2011 Stoll ..... A63B 22/0694 482/52
9,889,335 B2 * 2/2018 Palmer ..... A63B 22/0694
2007/0287619 A1 * 12/2007 Tuller ..... A63B 21/4047 482/123
2009/0029804 A1 * 1/2009 Crawley ..... A63B 69/0097 473/432
2015/0165255 A1 * 6/2015 Chen ..... A63B 23/0494 482/130

* cited by examiner

MULTI-FUNCTION FOLDABLE EXERCISE EQUIPMENT

FIELD

This disclosure relates to exercise equipment and, particularly to home use exercise equipment that may be easily stowed flat when not in use.

BACKGROUND

Many people who would like to exercise at home have relatively small living area, and so it makes it difficult or impossible to have large exercise equipment. Therefore, the equipment should preferably be either small or foldable to enable to stow away when not in use. Also, as it may not be easy to have several different equipment, so it is preferable that a single unit enable various settings for different exercises. Finally, it would be beneficial if the equipment is light and can be easily carried from room to room when needed.

SUMMARY

The following summary is included in order to provide a basic understanding of some aspects and features of the invention. This summary is not an extensive overview of the invention and as such it is not intended to particularly identify key or critical elements of the invention or to delineate the scope of the invention. Its sole purpose is to present some concepts of the invention in a simplified form as a prelude to the more detailed description that is presented below.

Embodiments disclosed herein describe exercise equipment that satisfy the issues highlighted above. The embodiments provide light equipment that can be easily carried by one person. The equipment is foldable to enable easy stow away when not in use. The equipment can be transformed to different arrangement to enable different exercises.

Various embodiments and features are designed to provide flexible reconfiguration of the exercise equipment to have an S-shape or a W-shape bars, thus enabling different exercises for different muscles, e.g., hamstring and hip exercises.

According to disclosed aspects, tension or exercise resistance adjustment provides different workloads or difficulty levels.

According to further aspects rollable handles are provided over the paddles allowing the user to hold onto the handles while the paddles rotate in either S-shape or W-shape configuration.

According to disclosed embodiments, an exercise equipment is provided which comprises: a base having a root and two branches forming a U-shape; a first arm rotatably connected at a first connecting point of a first branch of the two branches; a second arm rotatably connected a second connecting point of a second branch of the two branches; a first paddle rotatably connected to the first arm; a second paddle rotatably connected to the second arm; a connector connected at one end to the first paddle and at the second end to the second paddle, to thereby form an S-shape together with the first and second paddles; and, at least one variable friction pivot assembly attached at the first or second connecting points.

Other features and aspects are described in the following Detailed Description with reference to the Drawings.

BRIEF DESCRIPTION OF THE DRAWINGS

The accompanying drawings, which are incorporated in and constitute a part of this specification, exemplify the embodiments of the present invention and, together with the description, serve to explain and illustrate principles of the invention. The drawings are intended to illustrate major features of the exemplary embodiments in a diagrammatic manner. The drawings are not intended to depict every feature of actual embodiments nor relative dimensions of the depicted elements, and are not drawn to scale.

FIG. 2A is a cross-section thereof in a tight position, while

DETAILED DESCRIPTION

Embodiments of the inventive exercise equipment will now be described with reference to the drawings. Different embodiments or their combinations may be used for different applications or to achieve different benefits. Depending on the outcome sought to be achieved, different features disclosed herein may be utilized partially or to their fullest, alone or in combination with other features, balancing advantages with requirements and constraints. Therefore, certain benefits will be highlighted with reference to different embodiments, but are not limited to the disclosed embodiments. That is, the features disclosed herein are not limited to the embodiment within which they are described, but may be "mixed and matched" with other features and incorporated in other embodiments.

Various embodiments and features described below are designed in order to enable the user to exercise different muscles of the body in different standing/sitting orientations. Additionally, the user is able to adjust the resistance force applied against the user's action, so as to control the efforts required during the exercise. Further, disclosed embodiments provide equipment that is light and can be folded for easy stowage.

Figure 1:
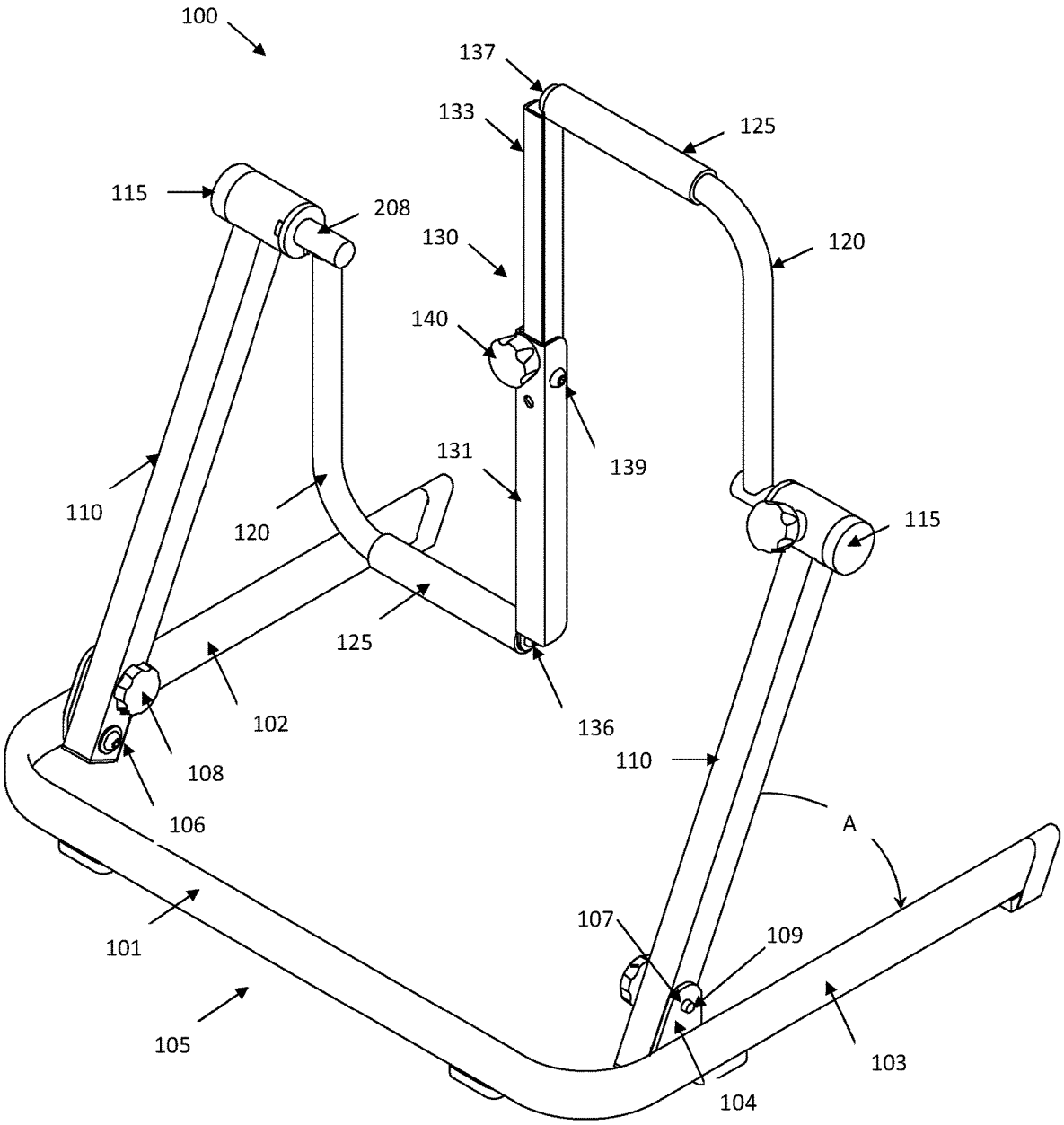
FIG. 1 illustrates an exercise equipment according to disclosed embodiment.

FIG. 1 illustrates exercise equipment 100 according to an embodiment. The major elements of the equipment 100 include a base 105, two foldable arms 110, each arm rotatably attached at one of its ends to the base, and includes a pivot assembly 115 at its opposite end. Further, a paddle 120 includes a handle 125 and is attached to each of the pivot assemblies. The two paddles 120 are commonly attached to foldable connecting bar assembly 130. These major elements will now be described in more details, together with an explanation of their functionality and features.

As illustrated in FIG. 1, the base 105 is formed from an elongated tube, having a rounded rectangular cross-section, and is bent into a U-shape. The base 105 hence forms a root 101 of the U-shape and a first branch 102 and second branch 103 of the U-shape. As will be disclosed further below, for most of the exercises it is intended that the equipment 105 be used such that the root 101 faces the user, while the two branches point away from the user. In this sense, branch 102 can be considered as the left branch while branch 103 as the right branch. However, since equipment 100 is generally symmetrical, reference for right and left are just for the convenience of description.

With further reference to FIG. 1, each of the branches 102 and 103 includes a support flange 104 attached at its end proximal to the root 101 (only one clearly visible in FIG. 1). Each of the support flanges 104 includes a pin 106 rotatably connecting one arm 110 to the respective branch 102 and 103. Additionally, each of the flanges 104 includes a hole 107 for receiving engagement pin 109, which is attached to knob 108. The knob 108 may be used to engage the pin 109 into hole 107 such that the arms 110 are fixedly attached at an acute angle A to the respective branch. Conversely, knob 108 can be used to disengage the pin 109 from hole 107, such that the arms 110 are free to rotate and fold to the same plane formed by base 105. For example, the pin 109 may include a threaded end and hole 107 may include a receiving thread, such that using knob 108 the pin may be screwed into hole 107. Conversely the pin 109 may be spring loaded and can be disengaged from hole 107 by pulling on knob 108.

As illustrated in FIG. 1, a pivot assembly 115 is attached to the extended end of each arm 110. The pivot assembly 115 allows paddle 120 to rotated about the pivot in continuous revolutions. However, at least one of the pivot assemblies 115 includes a variable friction device, which enables a user to change the amount of friction applied to the rotation of the arm, thereby changing the force required to rotate the arm. The variable friction pivot assembly is illustrated in more details in FIGS. 2-2B.

Figure 2:
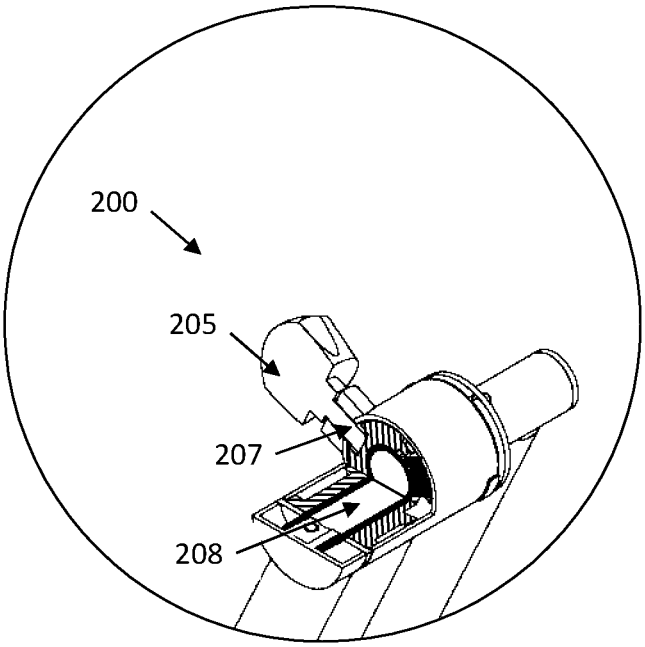
FIG. 2 is cutout illustration of a variable resistance pivot assembly, according to disclosed embodiment.
Figure 2A:
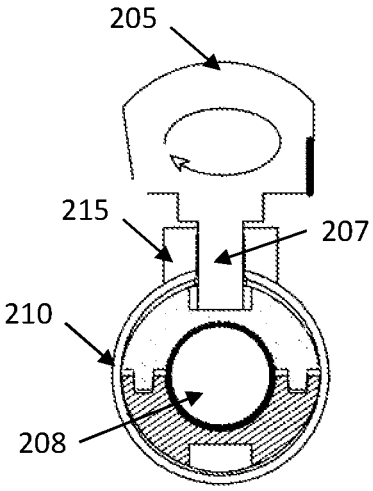
Figure 2B:
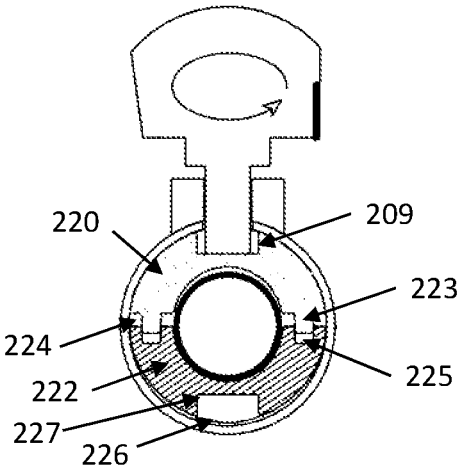
FIG. 2B is a cross-section thereof in a loose position.

FIG. 2 is a cut-out of part of a variable friction pivot assembly 200, according to an embodiment, showing its internal construction. FIG. 2A is a cross-section of the variable friction pivot assembly 200 in its increased friction position, while FIG. 2B is a cross-section of the variable friction pivot assembly 200 in its decreased friction position. To control the amount of friction, a user would turn knob 205, which is attached to a threaded pin 207. The threads of pin 207 engage the internal thread of threaded nut or bushing 215, which is attached, e.g., welded, to the cylindrical housing 210. A two-part cylindrical bushing is positioned inside the housing 210. The two-part cylindrical bushing is made of a first semi-cylindrical or a half pipe bushing part 220 and a second semi-cylindrical or half pipe bushing part 222, both of which may be made of plastic. The engagement rod 208 of paddle 110 is inserted between the two semi-cylindrical bushing parts. The second semi-cylindrical bushing part 222 is stationary and is held in place by engaging fixed key 226 engaging keyway 227 (fixed key 226 is fixedly attached to the inner wall of housing 210).

The first semi-cylindrical bushing part 220 also includes a key seat 209, which is engaged by the threaded pin 207. The rotation of pin 207 within the threaded nut 215 causes the pin 207 to move inward and outward with respect to the key seat 209, thus increasing or decreasing its pressing engagement on the first semi-cylindrical bushing part 220. As more pressure is applied to the first semi-cylindrical bushing part 220 by the pin 207, the first semi-cylindrical bushing part 220 moves towards the second semi-cylindrical bushing part 222, and consequently presses on the engagement rod 208. As the pressure increases on the engagement rod 208, the more difficult it is to rotate the paddles. As illustrated, gap 224 in FIG. 2B indicates that the first semi-cylindrical bushing part 220 is not pressed much against the second semi-cylindrical bushing part 222. Conversely, the gap 224 narrows in FIG. 2A, indicating an increase in pressure. Additionally, in this embodiment the first semi-cylindrical bushing part 220 includes a protrusion 223 which mates with indent 225 in the second semi-cylindrical bushing part 220, thereby maintaining alignment of the two semi-cylindrical bushing parts.

Turning back to FIG. 1, each paddle 120 includes a handle 125, which may be fixed or rollable over the paddle 120. The foldable connecting bar assembly 130 connects the two paddles 120. The foldable connecting bar assembly 130 is made of a first hollow rod 131 rotatably attached at one end to paddle 120 via pin 136, and a second hollow rod 133 rotatably attached at one end to the other paddle 120 via pin 137. The free ends of the first and second hollow rods are rotatably attached together via pin 139. The first hollow rod 131 is configured to house or accommodate the second hollow rod 133 inside it, when the holding bolt 140 is loosened, as will be demonstrated below with respect to FIGS. 3A-3C. In this respect, the first hollow rod 131 may also be referred to as a housing rod, while the second hollow rod 133 may be referred to as housed rod.

Figure 3A:
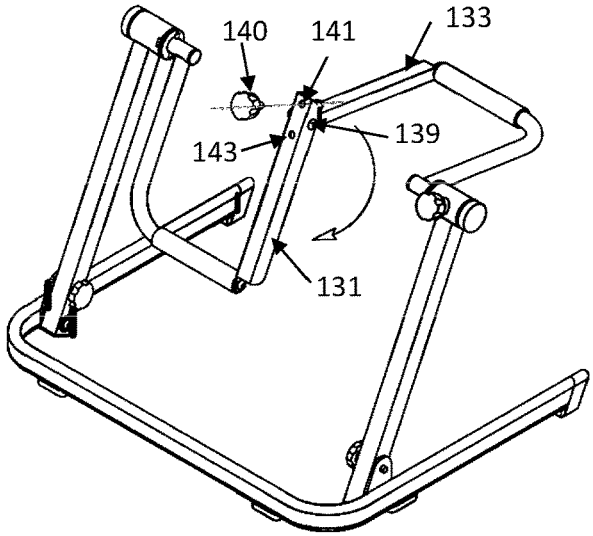
FIGS. 3A-3C illustrate the process of folding the equipment for stowage, according to disclosed embodiment.
Figure 3B:
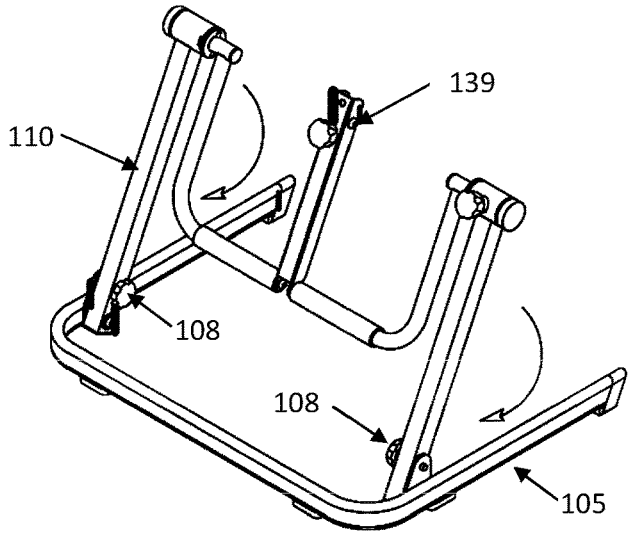
Figure 3C:
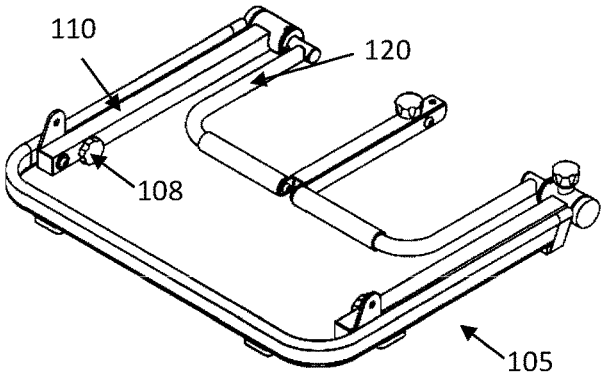

FIGS. 3A-3C illustrate the process of folding the equipment for stowage. In FIG. 3A the holding bolt 140 is removed from its first retaining position and the second hollow rod 133 is folded as shown by the curved arrow. In FIG. 3B the second hollow rod 133 is housed within the first hollow rod 131 and the holding bolt is secured into its second retaining position 143, so as to secure the second hollow rod in its folded position. Also, in FIG. 3B knobs 108 are loosened, so that the two arms 110 can be folded as illustrated by the curved arrows. The arms 110 are folded such that the base, arms 110, and paddles all lie in the same plane, as illustrated in FIG. 3C. This enables the equipment to be stowed either horizontally under furniture, or vertically in a very narrow space or braced against a wall.

Referring back to FIG. 3A, first hollow rod 131, which may also be referred to as the housing rod 131, has a first securing hole 141 and a second securing hole 143. Also, in one example, the second hollow rod 133, which may also be referred to as the housed rod 133, has two securing threads (obscured in the Figures) matching the first as second secure holes 141 and 143. In this example, the first securing thread is on one face of the housed rod 131 and the second secured thread is on the opposite face of the housed rod 131. Consequently, when the housed rod 133 is in the extended position illustrated in FIG. 1, the first securing thread faces and mates with the first securing hole 141, while the second securing thread faces away from the housing rod 133. Conversely, when the housed rod 133 is in its folded position, as illustrated in FIG. 3B, the second securing thread faces the second securing hole 143, while the first securing thread faces away from the housing rod 133. Conversely, since the first securing hole 141 and the second securing hole 143 are positioned equidistance from the pin 139, the same point of housed rod 131 that is aligned with the first securing hole 141 in its extended position is also aligned with the second securing hole 143 in its folded position. Therefore, a single "double-faced" securing thread may be provided at that point on the housed rod 133.

Figure 4A:
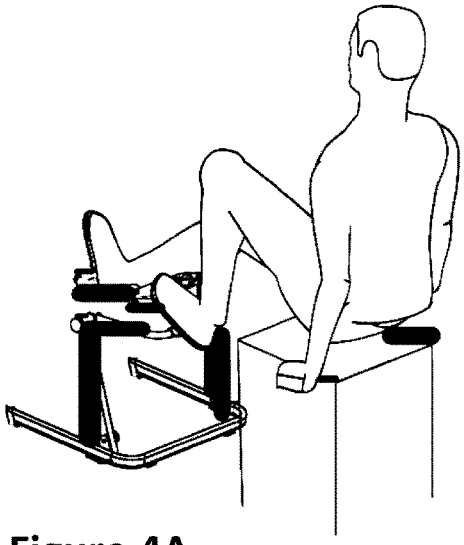
FIGS. 4A and 4B illustrate usage of the exercise equipment emulating a bicycle ride.
Figure 4B:
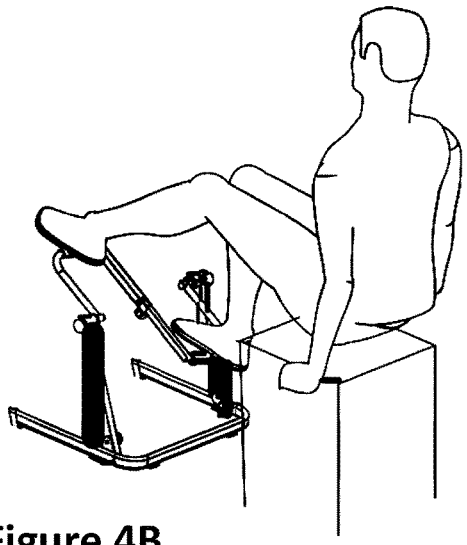

The disclosure will now provide examples of the manner of using the exercise equipment. A first example is illustrated in FIGS. 4A and 4B, wherein the user is seated and the equipment is placed on the floor. In this example the housed rod 133 is in its extended position and the holding bolt 140 is securing the housed rod 133 via the first securing hole 141. In this position, the two paddles are positioned at a 180° opposed to each other, such that paddles 120 are on the opposite sides of bolt 140, thereby forming an S-shape. This position is akin to the arrangement of bicycle paddles and the user illustrated in FIGS. 4A and 4B is exercising in a similar manner to paddling bicycle. The amount of resistance can be adjusted by the variable friction pivot assembly 200.

Figure 5A:
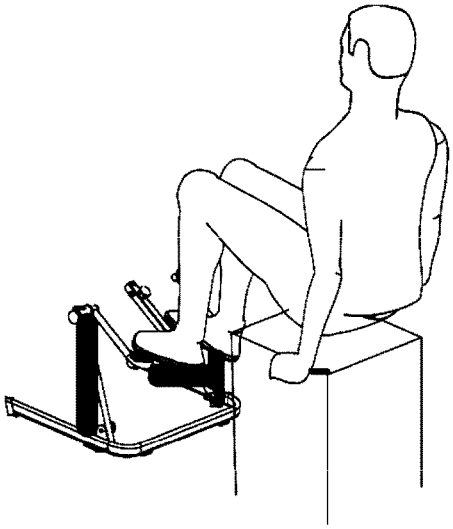
FIGS. 5A and 5B illustrate usage of the exercise equipment while moving the legs in unison.
Figure 5B:
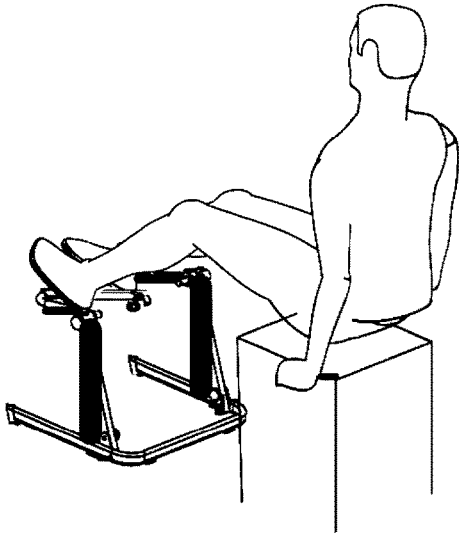

A second example is illustrated in FIGS. 5A and 5B, wherein the user is again seated and the equipment is placed on the floor. In this example the housed rod 133 is in its folded position and the holding bolt 140 is securing the housed rod 133 via the second securing hole 143. In this position, the two paddles are positioned aligned to each other, such that both paddles 120 are on the same side of bolt 140, thereby forming a W-shape. This position is beneficial for activating both legs in unison. The amount of resistance can be adjusted by the variable friction pivot assembly 200.

Figure 6A:
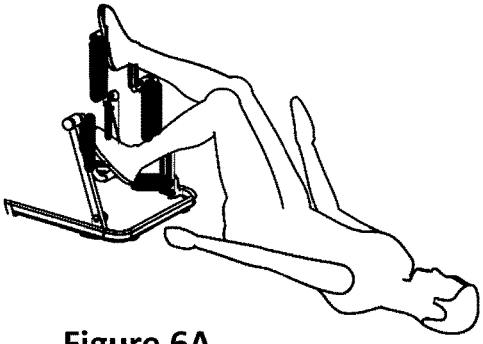
FIGS. 6A and 6B illustrate usage of the exercise equipment emulating a bicycle ride while laying on one's back.
Figure 6B:
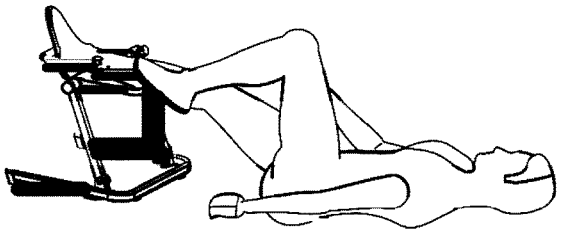
Figure 7A:
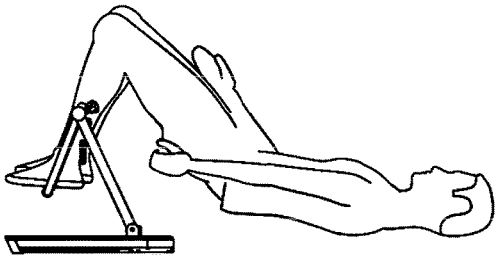
FIGS. 7A and 7B illustrate usage of the exercise equipment while moving the legs in unison and laying on one's back.
Figure 7B:
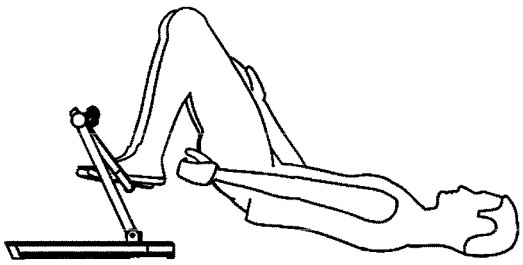

FIGS. 6A and 6B illustrate a user laying on his back on the floor and the equipment is in the bicycle simulation, wherein the housed rod 133 is in its extended position and the holding bolt 140 is securing the housed rod 133 via the first securing hole 141. FIGS. 7A and 7B illustrate a user laying on his back on the floor and the equipment is arranged such that the housed rod 133 is in its folded position and the holding bolt 140 is securing the housed rod 133 via the second securing hole 143. This position is somewhat similar to a swing position, wherein the legs move in unison.

Figure 8A:
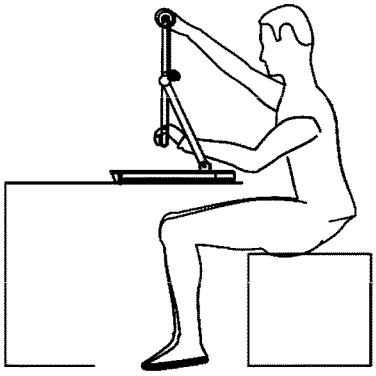
FIGS. 8A and 8B illustrate usage of the exercise equipment emulating paddling a bicycle with hands while seated.
Figure 8B:
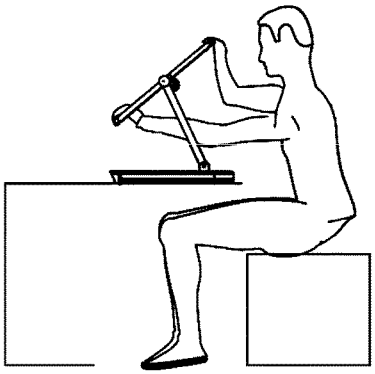

FIGS. 8A and 8B illustrate a user seated and the equipment is positioned on a table in front of the user. The equipment is arranged in the bicycle simulation, wherein the housed rod 133 is in its extended position and the holding bolt 140 is securing the housed rod 133 via the first securing hole 141. The user operates the paddles with his hands, rather than with the legs. For these exercises, the handles 125 are not mandatory, and instead the user may engage the paddles without having the handles. However, if handles 125 are provided, it is beneficial if the handles 125 are rollable over paddles 120.

Figure 9:
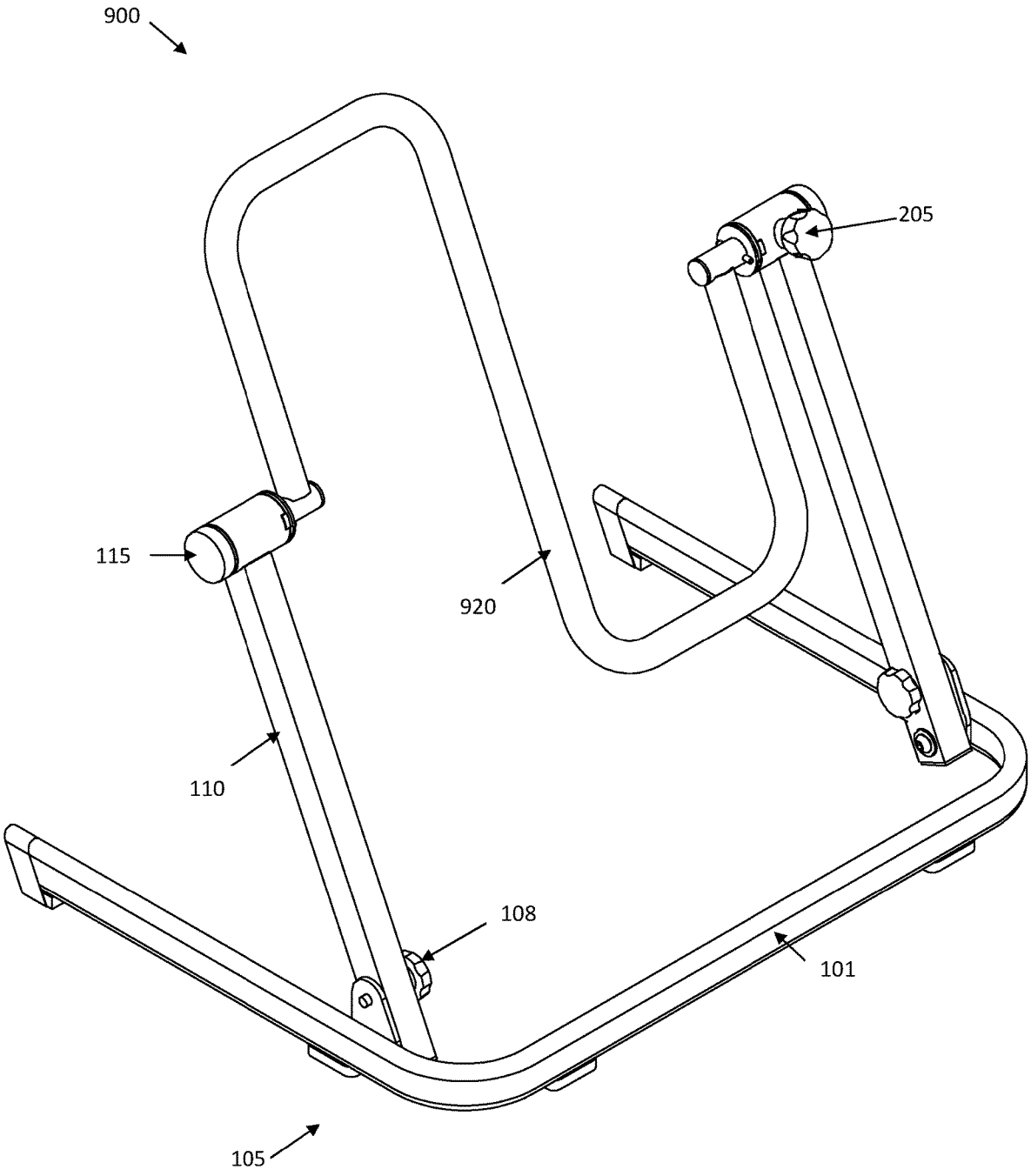
FIGS. 9 and 9A illustrate another embodiment of the exercise equipment.
Figure 9A:
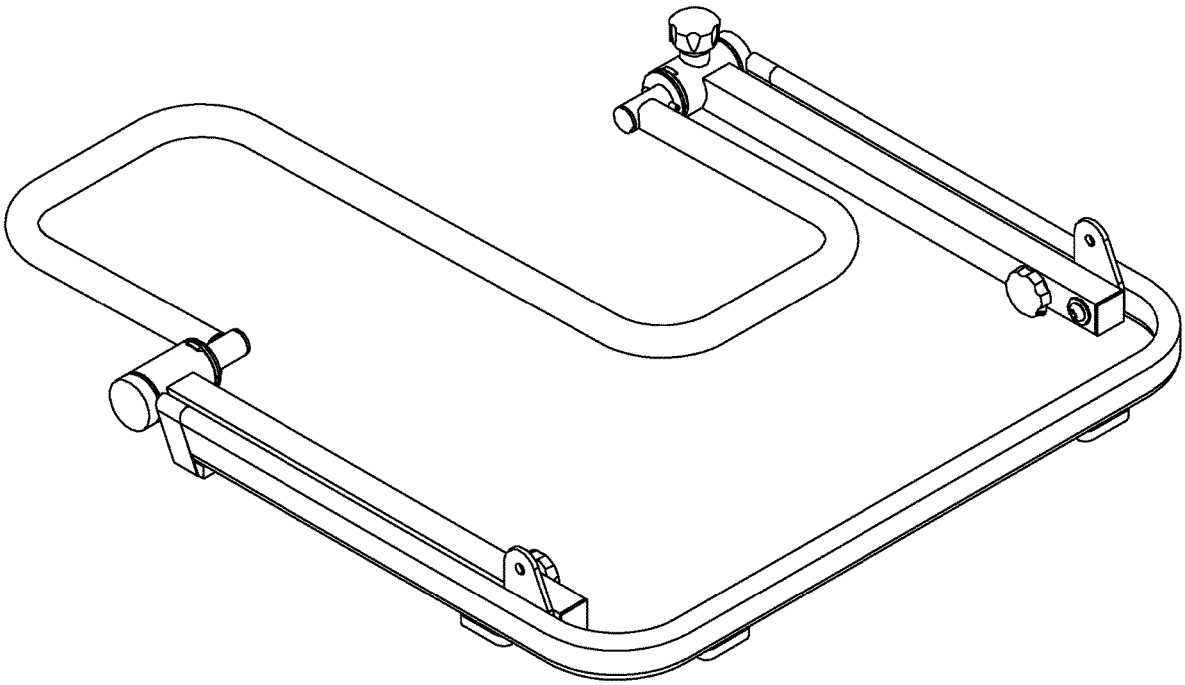

FIG. 9 illustrates another embodiment of the exercise equipment. The embodiment of FIG. 9 is very similar to that of FIG. 1, and the same elements are identified with the same reference numerals. However, unlike the prior embodiments, in FIG. 9 the paddles 920 do not fold and are formed by a single tube folded as an S shape. However, since arms 110 still fold flat, the entire equipment can still be folded flat for stowage, as illustrated in FIG. 9A.

Figure 10:
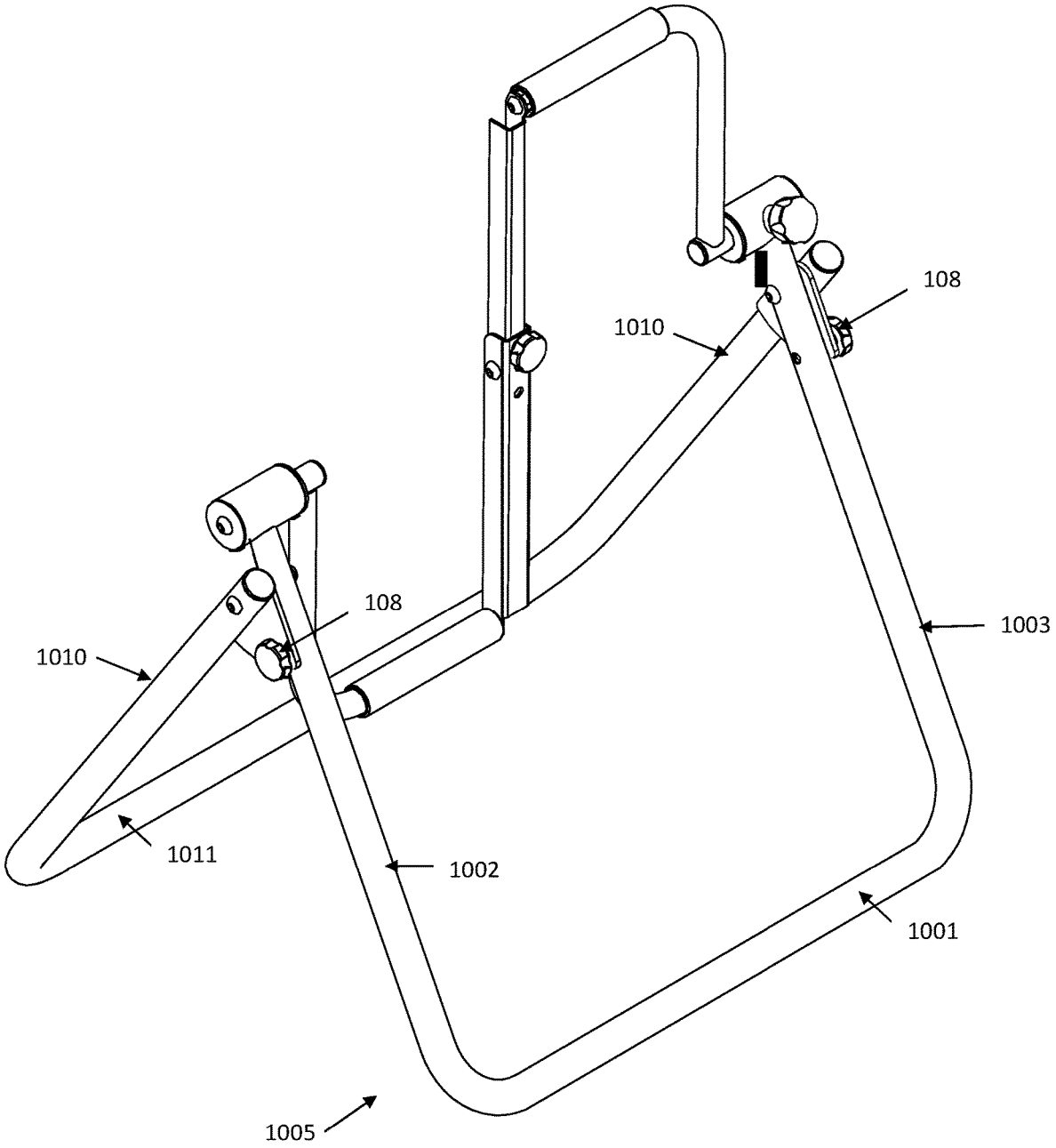
FIGS. 10 and 10A illustrate yet another embodiment of the exercise equipment.
Figure 10A:
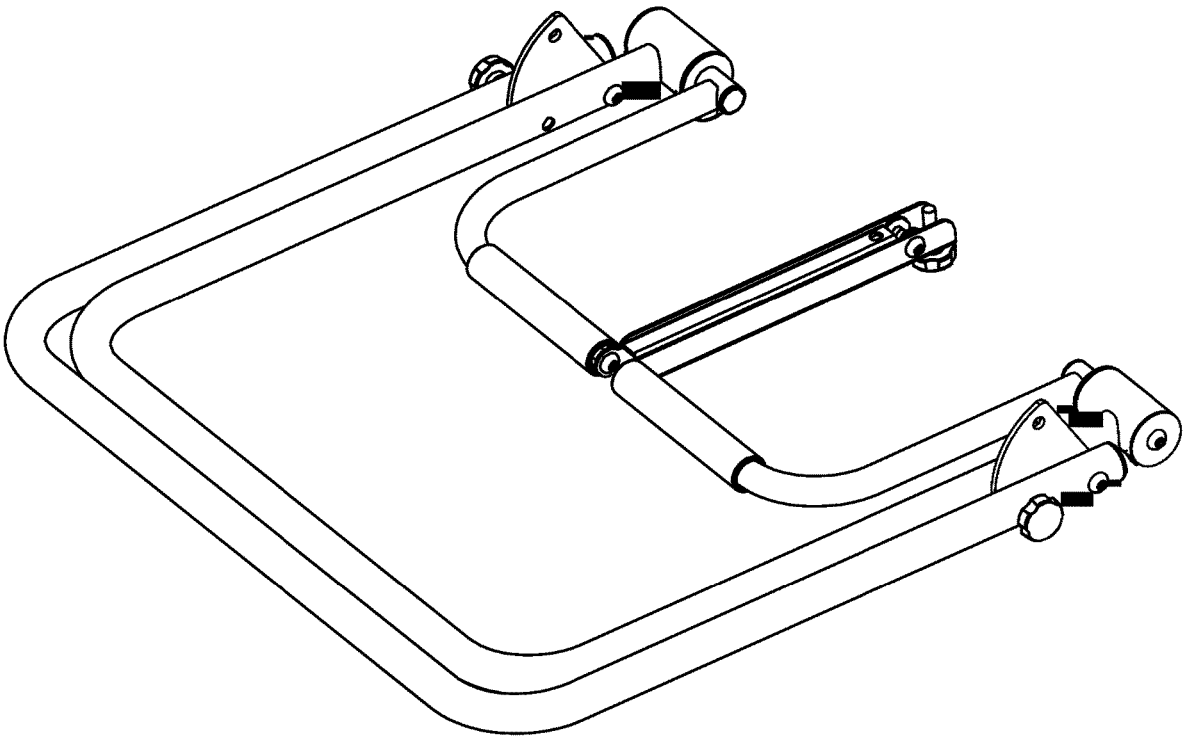

FIGS. 10 and 10A illustrate another example of the exercise equipment according to an embodiment. The example of FIG. 10 is similar to that of FIG. 1, in that the paddles and the manner in which the paddles can be folded is maintained. On the other hand, the base and the arms are different. The base 1005 is still in a U-shape with root 1001 and two branches 1002 and 1003. On the other hand, the two arms 1010 are formed with root 1011 to also form a U-shape. The two U-shapes are rotatably connected together at the end of the branches distal to the root. The rotatable connection may be formed similar to that of FIG. 1, using knob 108 to loosen and affix the connection for folding and unfolding, as illustrated in FIG. 10A.

Thus, embodiments disclosed herein provide an exercising equipment, comprising: a base formed of a pipe bent to assume a U-shape having a root a first branch and a second branch; a first arm rotatably connected to a first branch of the two branches and having a securing knob engageable to affix the first arm at an acute angle to the first branch; a second arm rotatably connected to a second branch of the two branches and having a securing knob engageable to affix the second arm at an acute angle to the second branch; a first paddle rotatably connected at a first connecting point to the first arm; a second paddle rotatably connected at a second connecting point to the second arm; a foldable connecting bar assembly connected at one end to the first paddle and at the second end to the second paddle, to thereby form an S-shape together with the first and second paddles when assuming an extended position and form a W-shape together with the first and second paddles when assuming a folded position; and, at least one variable friction pivot assembly attached at the first or second connecting points thereby applying variable friction to rotation of at least one of the first or second paddles.

The variable friction pivot assembly may comprise: a cylindrical housing having a threaded hole on a sidewall thereof; a knob attached to a threaded pin, the threaded pin inserted in the threaded hole; a bushing comprising a first half pipe inserted inside the cylindrical housing, and a second half pipe inserted inside the cylindrical housing in a matting arrangement with the first half pipe; an engagement rod inserted in the bushing between the first half pipe and second half pipe and connected to one of the first and second paddles; and, wherein the threaded pin is configured to engage the first half pipe and press the first half pipe against the engagement rod and against the second half pipe upon threading.

The foldable connecting bar assembly may comprise: a housing rod having a first end rotatably connected to the first paddle; a housed rod having a first end rotatably connected to the second paddle and having a second end rotatably connected to a second end of the housing rod; a securing mechanism alternatingly securing the housed rod in an extended position extending in a straight direction from the housing rod, whereby the first paddle, foldable connecting bar assembly and the second paddle form an S-shape, and securing the housed rod in a folded position housed within the housing rod whereby the first paddle, foldable connecting bar assembly and the second paddle form a W-shape.

The first and second arms are foldable to a position lying flat within a plane defined by the base, and the first and second paddles are foldable to a position lying flat within the plane defined by the base, such that the base, the first and second arms, and the first and second paddles all occupy a single plane.

Various embodiments were described above, wherein each embodiment is described with respect to certain features and elements. However, it should be understood that features and elements from one embodiment may be used in conjunction with other features and elements of other embodiments, and the description is intended to cover such possibilities, albeit not all permutations are described explicitly so as to avoid clutter.

It should be understood that processes and techniques described herein are not inherently related to any particular apparatus and may be implemented by any suitable combination of components. Further, various types of general purpose devices may be used in accordance with the teachings described herein. The present invention has been described in relation to particular examples, which are intended in all respects to be illustrative rather than restrictive. Those skilled in the art will appreciate that many different combinations will be suitable for practicing the present invention.

Moreover, other implementations of the invention will be apparent to those skilled in the art from consideration of the specification and practice of the invention disclosed herein. Various aspects and/or components of the described embodiments may be used singly or in any combination. It is intended that the specification and examples be considered as exemplary only, with a true scope and spirit of the invention being indicated by the following claims.

The invention claimed is:

1. An exercising equipment, comprising:

a base having a root and two branches forming a U-shape;

a first arm rotatably connected to a first branch of the two branches;

a second arm rotatably connected to a second branch of the two branches;

a first paddle rotatably connected at a first connecting point to the first arm;

a second paddle rotatably connected at a second connecting point to the second arm;

a connector connected at a first end to the first paddle and at a second end to the second paddle, to thereby form an S-shape together with the first and second paddles, wherein the connector comprises a foldable connecting bar assembly alternatingly assuming an extended position and a folded position; and at least one variable friction pivot assembly attached at the first or second connecting points thereby applying variable friction to rotation of at least one of the first or second paddles.

2. The exercising equipment of claim 1, wherein the variable friction pivot assembly comprises:

a cylindrical housing having a threaded hole on a sidewall thereof;

a knob attached to a threaded pin, the threaded pin inserted in the threaded hole;

a bushing comprising a first half pipe inserted inside the cylindrical housing, and a second half pipe inserted inside the cylindrical housing in a mating arrangement with the first half pipe; and an engagement rod inserted in the bushing between the first half pipe and the second half pipe and connected to one of the first and second paddles, wherein the threaded pin is configured to engage the first half pipe and press the first half pipe against the engagement rod and against the second half pipe upon threading.

3. The exercising equipment of claim 2, wherein the variable friction pivot assembly further comprises:

the first half pipe comprising a protrusion on a surface thereof;

the second half pipe comprising an indent on a surface thereof, the indent configured and sized to accept the protrusion of the first half pipe.

4. The exercising equipment of claim 3, wherein the variable friction pivot assembly further comprises:

the cylindrical housing having a fixed key attached to interior wall thereof; and, the second half pipe having a keyway sized and configured to engage the fixed key to thereby prevent rotation of the second half pipe.

5. The exercising equipment of claim 4, wherein the first half pipe includes a key seat configured to accept the threaded pin.

6. The exercising equipment of claim 1, wherein the first arm and the second arm are integrally formed with a bottom bar, whereby the first arm, second arm and bottom bar form the U-shape.

7. The exercising equipment of claim 1, wherein when the foldable connecting bar assembly assumes its extended position it forms the S-shape with the first and second paddles, and when the foldable connecting bar assembly assumes its folded position it forms a W-shape with the first and second paddles.

8. The exercising equipment of claim 1, wherein the first and second arms are foldable to a position lying flat within a plane defined by the base, and the first and second paddles are foldable to a position lying flat within the plane defined by the base, such that the base, the first and second arms, and the first and second paddles all occupy a single plane.

9. The exercising equipment of claim 1, further comprising:

a first flange attached to the first branch;

a second flange attached to the second branch;

a first pin inserted through the first arm and the first branch to rotatably attach the first arm to the first branch, a second pin inserted through the second arm and the second branch to rotatably attach the second arm to the second branch;

a first knob threaded to the first flange through the first arm to thereby secure the first arm at an acute angle to a plane defined by the base; and a second knob threaded to the second flange through the second arm to thereby secure the second arm at an acute angle to the plane defined by the base.

10. The exercising equipment of claim 9, wherein each of the first and second knob comprises a spring-loaded pin.

11. An exercising equipment, comprising:

a base having a root and two branches forming a U-shape;

a first arm rotatably connected to a first branch of the two branches;

a second arm rotatably connected to a second branch of the two branches;

a first paddle rotatably connected at a first connecting point to the first arm;

a second paddle rotatably connected at a second connecting point to the second arm;

a connector connected at a first end to the first paddle and at a second end to the second paddle, to thereby form an S-shape together with the first and second paddles; and at least one variable friction pivot assembly attached at the first or second connecting points thereby applying variable friction to rotation of at least one of the first or second paddles, wherein the connector comprises a foldable connecting bar assembly having:

a housing rod having a first end rotatably connected to the first paddle;

a housed rod having a first end rotatably connected to the second paddle and having a second end rotatably connected to a second end of the housing rod; and a securing mechanism alternatingly securing the housed rod in an extended position extending in a straight direction from the housing rod, wherein the first paddle, foldable connecting bar assembly and the second paddle form the S-shape, and securing the housed rod in a folded position housed within the housing rod whereby the first paddle, foldable connecting bar assembly and the second paddle form a W-shape.

12. The exercising equipment of claim 11, wherein the foldable connecting bar assembly further comprises a holding pin inserted through the housing rod and the housed rod to thereby rotatably secure the housed rod within the housing rod.

13. The exercising equipment of claim 12, wherein the foldable connecting bar assembly further comprises:

the housing rod having a first securing hole and a second securing hole, the first securing hole and the second securing holes positioned equidistance from the holding pin;

the housed rod having a securing thread alternatingly aligned with the first securing hole or the second securing hole;

a holding bolt alternatingly insertable through the first securing hole or the second securing hole and engage the securing thread.

14. The exercising equipment of claim 13, wherein the securing thread comprises a first thread positioned on a first surface of the housed rod and a second thread positioned on a second surface of the housed rod, opposite the first surface.

15. The exercising equipment of claim 13, wherein each of the paddles further comprises a handle rollable over each of the paddles.

16. An exercising equipment, comprising:

a base formed of a pipe bent to assume a U-shape having a root a first branch and a second branch;

a first arm rotatably connected to a first branch of the two branches and having a securing knob engageable to affix the first arm at an acute angle to the first branch;

a second arm rotatably connected to a second branch of the two branches and having a securing knob engageable to affix the second arm at an acute angle to the second branch;

a first paddle rotatably connected at a first connecting point to the first arm;

a second paddle rotatably connected at a second connecting point to the second arm;

a foldable connecting bar assembly connected at a first end to the first paddle and at a second end to the second paddle, to thereby form an S-shape together with the first and second paddles when assuming an extended position and form a W-shape together with the first and second paddles when assuming a folded position; and at least one variable friction pivot assembly attached at the first or second connecting points thereby applying variable friction to rotation of at least one of the first or second paddles.

17. The exercising equipment of claim 16, wherein the variable friction pivot assembly comprises:

a cylindrical housing having a threaded hole on a sidewall thereof;

a knob attached to a threaded pin, the threaded pin inserted in the threaded hole;

a bushing comprising a first half pipe inserted inside the cylindrical housing, and a second half pipe inserted inside the cylindrical housing in a mating arrangement with the first half pipe; and an engagement rod inserted in the bushing between the first half pipe and second half pipe and connected to one of the first and second paddles, wherein the threaded pin is configured to engage the first half pipe and press the first half pipe against the engagement rod and against the second half pipe upon threading.

18. The exercising equipment of claim 16, wherein the foldable connecting bar assembly comprises:

a housing rod having a first end rotatably connected to the first paddle;

a housed rod having a first end rotatably connected to the second paddle and having a second end rotatably connected to a second end of the housing rod; and a securing mechanism alternatingly securing the housed rod in an extended position extending in a straight direction from the housing rod, wherein the first paddle, foldable connecting bar assembly and the second paddle form the S-shape, and securing the housed rod in a folded position housed within the housing rod whereby the first paddle, foldable connecting bar assembly and the second paddle form the W-shape.

19. The exercising equipment of claim 16, wherein the first and second arms are foldable to a position lying flat within a plane defined by the base, and the first and second paddles are foldable to a position lying flat within the plane defined by the base, such that the base, the first and second arms, and the first and second paddles all occupy a single plane.

20. The exercising equipment of claim 16, wherein each of the paddles further comprises a handle rollable over the paddle.

* * * * *